United States Patent [19]

Soga et al.

[11] Patent Number: 5,054,301

[45] Date of Patent: Oct. 8, 1991

[54] METHOD OF FORMING METALLIC PRODUCT

[75] Inventors: Ryuji Soga; Nobuaki Hojo; Kenichia Hakozaki; Hisayuki Sakurai; Shigehisa Seya, all of Sayama, Japan

[73] Assignee: Honda Giken Kogyo Kabushiki Kaisha, Tokyo, Japan

[21] Appl. No.: 527,266

[22] Filed: May 23, 1990

[30] Foreign Application Priority Data

Mar. 26, 1990 [JP] Japan ..... 2-76174

[51] Int. Cl.[5] ..... B21J 5/08

[52] U.S. Cl. ..... 72/8; 72/318; 72/342.96; 219/150 R; 29/888.43

[58] Field of Search ..... 72/318, 342.96, 342.1, 72/356, 11, 13, 8; 29/888.451, 888.43; 10/27 H; 219/150 R

[56] References Cited

U.S. PATENT DOCUMENTS

| | | | |
|---|---|---|---|
| 2,836,706 | 5/1958 | Cavanagh | 72/342.1 |
| 3,728,887 | 4/1973 | Bachmann | 72/318 |
| 4,151,732 | 5/1979 | Hofstede | 72/8 |
| 4,263,799 | 4/1981 | Motizuki | 72/318 |
| 4,741,080 | 5/1988 | Larson et al. . | |

FOREIGN PATENT DOCUMENTS

| | | | |
|---|---|---|---|
| 56-45244 | 4/1981 | Japan . | |
| 57-62830 | 4/1982 | Japan . | |
| 59-85341 | 5/1984 | Japan . | |
| 59-157743 | 10/1984 | Japan . | |
| 60-61134 | 4/1985 | Japan . | |
| 60-83736 | 5/1985 | Japan . | |
| 60-92034 | 5/1985 | Japan . | |
| 60-96342 | 5/1985 | Japan . | |
| 60-96343 | 5/1985 | Japan . | |
| 60-127037 | 7/1985 | Japan . | |
| 60-127038 | 7/1985 | Japan . | |
| 60-133945 | 7/1985 | Japan . | |
| 60-213329 | 10/1985 | Japan . | |
| 60-213330 | 10/1985 | Japan . | |
| 62-34642 | 2/1987 | Japan . | |
| 62-144841 | 6/1987 | Japan . | |
| 62-151238 | 7/1987 | Japan . | |
| 62-220239 | 9/1987 | Japan . | |
| 2-46942 | 2/1988 | Japan . | |
| 2-147140 | 6/1988 | Japan . | |
| 64-57940 | 3/1989 | Japan . | |
| 569514 | 5/1945 | United Kingdom | 72/356 |
| 818196 | 8/1959 | United Kingdom . | |
| 1386702 | 3/1975 | United Kingdom . | |

*Primary Examiner*—Daniel C. Crane

[57] ABSTRACT

A metallic product is formed by an electric upsetter having anvil and clamp electrodes. The anvil electrode is made of a material having a relatively small thermal conductivity. A rod-shaped blank of a metallic material is placed between the anvil and clamp electrodes. Then, an electric current is passed through the rod-shaped blank to heat the same. The rod-shaped blank is pushed toward the anvil electrode under a constant force to thicken an end of the rod-shaped blank which is held against the anvil electrode. The electric current passed through the rod-shaped blank is controlled such that the rod-shaped blank is pushed at a predetermined speed depending on a displacement by which the rod-shaped blank is pushed toward the anvil electrode, thereby producing a preliminary product with the thickened end. The preliminary product is subsequently formed into an engine valve by closed-die forging.

13 Claims, 8 Drawing Sheets

METHOD OF FORMING METALLIC PRODUCT

BACKGROUND OF THE INVENTION

The present invention relates to a method of forming a metallic product, and more particularly to a method of forming an engine valve.

There are known various methods of forming engine valves for use as intake and exhaust valves. According to one conventional method, a rod-shaped blank, which is larger in diameter than the stem of a valve to be formed, is heated and then extruded, except for one end thereof, into a preliminary product having a reduced diameter that is the same as the diameter of the valve stem. Thereafter, the larger-diameter end, which was not extruded, of the preliminary product is formed into a valve head, and any burrs on the valve head are removed by trimming, thereby forming the valve. The above valve forming method is referred to as an "extrusion process".

Another prior method uses an electric upsetter which has an anvil electrode and a crank electrode for sandwiching a rod-shaped blank having substantially the same diameter as that of the stem of a valve to be formed. When the rod-shaped blank is sandwiched between the anvil and crank electrodes, an electric current is passed through the blank between the electrodes while at the same time the blank is being pressed thereby to form a preliminary product with a thickened end having a larger diameter. The thickened end is then formed into a valve head and deburred by trimming, producing the valve. This method of forming a valve is referred to as an "electric upsetting process".

To meet a growing demand for hither engine power output and performance, various efforts are being made to make engines lighter and improve intake and exhaust efficiencies. One attempt is directed to reducing the diameter of valve stems and increasing the diameter of valve heads, i.e., increasing the ratio of the diameter of valve heads to the diameter of valve stems. Such an attempt necessitates an increase in the mechanical strength and heat resistance of valves. In view of this, some valves are made of heat-resistant superalloys.

The desired valve configurations and materials require that the following conditions be satisfied in the formation of valves:

First, since heat-resistant superalloys used as valve materials are difficult to form, they are subjected to less plastic deformation. For forming a valve head, it is necessary that the larger-diameter or thickened end of a preliminary product be reliably shaped as desired with its diameter close to that of the desired valve head. Secondly, because heat-resistant superalloys are generally expensive, it is preferable to form valve heads by closed-die forging so that no burrs will be produced and hence no trimming is required, with the result that valves can be produced with an increased yield.

According to the extrusion process, when a preliminary product is formed, a rod-shaped blank tends to be easily cooled by contact with a die. This fact, together with the difficult formability of heat-resistant superalloys, prevents the diameter of the rod-shaped blank from being greatly reduced. In order to produce a valve with a thin stem, it is necessary to employ a small-diameter rod-shaped blank. If a small-diameter rod-shaped blank is employed, however, then the larger-diameter end of a preliminary product cannot be enlarged to the desired diameter of the head of a valve to be formed.

For increasing the diameter of the head of a valve, the larger-diameter end of the preliminary product has to be greatly enlarged when the valve head is formed. At this time, the formed valve head is liable to crack. When the valve head is to be formed, inasmuch as the larger-diameter end of the preliminary product has to be deformed to a large extent, the plastic deformation thereof must be effected smoothly. However, such smooth plastic deformation cannot be achieved by closed-die forging.

As described above, the rod-shaped blank is cooled by the die when it is formed into the preliminary product. The preliminary product should therefore be reheated before its larger-diameter end is shaped into a valve head. The reheating step necessarily increases the number of steps required to produce valves and lowers the production efficiency.

According to the electric upsetting process, the thickened end of a preliminary product is formed by upsetting one end of the preliminary product while heating the end. Therefore, the electric upsetting process makes it possible to allow the thickened end to have a relatively large diameter as compared with the stem of the preliminary product. The preliminary product is not required to be reheated before its thickened end is formed into a valve head. The electric upsetting process is therefore more suitable than the extrusion process for increasing the ratio of the diameter of the head to the diameter of the stem of a valve. However, the rod-shaped blank is required to be small in diameter in order that the stem of a formed valve will be thin. With the electric upsetting process, it is generally difficult to form the preliminary product into a desired shape from which a valve stem can reliably be obtained.

With the electric upsetting process, since the shape of a preliminary product is not confined or forcibly defined by a die or the like, when a rod-shaped blank is reduced in diameter, it is apt to have some defects such as cracking, buckling, material localization, or wrinkling. In order to eliminate such deficiencies and reliably form a preliminary product of desired shape, it is necessary to accurately control the speed at which one end, to be formed into a thickened end, of a rod-shaped blank, is displaced or pushed toward the anvil electrode of an electric upsetter and also the temperature to which the rod-shaped blank is to be heated, depending on the material of the rod-shaped blank.

Japanese Laid-Open Patent Publication No. 60(1985)-127037 discloses a mechanical control system for controlling the pushing speed at which a rod-shaped blank is pushed toward an anvil electrode. The disclosed mechanical control system employs a cylinder for pushing or displacing the rod-shaped blank, and the pushing speed is mechanically controlled by the control of a pushing force produced by the cylinder. However, the pushing speed cannot accurately be controlled by the disclosed mechanical control system.

The anvil electrode of an electric upsetter is normally made of a highly electrically conductive material such as a copper alloy or the like. The anvil electrode of such a material is also highly thermally conductive, the heat of a rod-shaped blank which is pressed against the anvil electrode is transferred away from the rod-shaped blank through the anvil electrode, making the temperature of the rod-shaped blank unstable. It has been difficult to achieve stable control of the temperature of the heated rod-shaped blank.

Even if the pushing speed is controlled in the conventional electric upsetting process, therefore, various problems still remain to be solved when preliminary products are formed, and the formed preliminary products tend to have different shapes. If the formed preliminary products are not uniform in their shape, then when valve heads are formed from the preliminary products, necks positioned between the valve heads and stems of valves are liable to wrinkle. The inventors have found that such wrinkles on the necks are more appreciably produced when the valve heads are formed by closed-die forging.

The inventors have made various efforts to analyze the problems described above. As a result of the study, the inventors have found that the pushing speed at which a rod-shaped blank is pushed toward an anvil electrode can accurately be controlled by controlling a current supplied to the rod-shaped blank, insofar as the pushing force applied to push the rod-shaped blank toward the anvil electrode is constant.

The inventors have also found that the temperature of an anvil electrode can stably be maintained if it is made of a nicked- or cobalt-base heat-resistant superalloy which is less thermally conductive than copper alloys.

The inventors have also concentrated their efforts to find out why wrinkles tend to be created on a valve neck when a valve head is formed by closed-die forging. As a result, it has been discovered that there is a close relationship between the angle of inclination from the stem toward the thickened portion of a preliminary product (hereinafter referred to as a "thickened-portion angle") and the angle of inclination of a forming surface of a die which forms an inclined surface of the valve neck (hereinafter referred to as a "forming-surface angle").

More specifically, if the thickened-portion angle is larger than the forming-surface angle, then there is created a relatively large gap or clearance between the preliminary product and the forming surface of the die, which are therefore not held in close contact with each other. When the valve head is formed, the material of the preliminary product near the forming surface is likely to be easily displaced inwardly, resulting in wrinkles on the valve neck. This defect manifests itself since the thickened end of the preliminary product is less subjected to plastic deformation in closed-die forging.

SUMMARY OF THE INVENTION

It is an object of the present invention to provide a method of forming a metallic product by upsetting a rod-shaped blank of a metallic material easily to a desired shape with an electric upsetter while reliably maintaining suitable conditions such as a heating condition and a pushing speed.

Another object of the present invention is to provide a method of forming a metallic product such as a preliminary product for an engine valve reliably to a desired shape using an electric upsetter.

Still another object of the present invention is to provide a method of forming a metallic product such as an engine valve of high quality from a preliminary product at a high yield rate through the formation of a valve head by closed-die forging.

According to the present invention, the above object can be achieved by a method of forming a metallic product with an electric upsetter having anvil and clamp electrodes, comprising the steps of employing the anvil electrode which is made of a material having a relatively small thermal conductivity, placing a rod-shaped blank of a metallic material between the anvil and clamp electrodes, passing an electric current through the rod-shaped blank to heat the same, pushing the rod-shaped blank toward the anvil electrode under a constant force to thicken an end of the rod-shaped blank, and controlling the electric current passed through the rod-shaped blank such that the rod-shaped blank is pushed at a predetermined speed depending on a displacement by which the rod-shaped blank is pushed toward the anvil electrode, thereby producing a preliminary product with the thickened end.

Since the thermal conductivity of the anvil electrode is relatively low, heat is prevented from being transferred from the rod-shaped blank through the anvil when the rod-shaped blank is upset by the electric upsetter. Therefore, the rod-shaped blank is heated to and kept stably in a desired temperature. Since the speed at which the rod-shaped blank is pushed toward the anvil electrode is controlled by only the current passed through the rod-shaped blank while it is being pushed under the constant force, the rod-shaped blank can be pushed easily at the predetermined speed depending on the displacement by which it is pushed. The rod-shaped blank can therefore be formed into a metallic product of desired shape.

Furthermore, there is also provided a method of forming a metallic product with an electric upsetter having anvil and clamp electrodes, the anvil electrode being made of a nickel- or cobalt-base heat-resistant superalloy whose thermal conductivity is about 0.03 J/cm.A.K. or less, the method comprising the steps of placing a rod-shaped blank which is made of a heat-resistant superalloy having substantially the sam compositions as the anvil electrode, between the anvil and clamp electrodes, passing an electric current through the rod-shaped blank to heat the same, while applying a constant force to push the rod-shaped blank toward the anvil electrode, controlling the electric current passed through the rod-shaped blank such that the rod-shaped blank is pushed at a predetermined speed depending on a displacement by which the rod-shaped blank is pushed toward the anvil electrode, thereby producing a preliminary product with a thickened end, and forming the thickened end into a head by closed-die forging, thereby producing an engine valve.

Since the anvil electrode of the electric upsetter is made of a nickel- or cobalt-base heat-resistant superalloy with a relatively low thermal conductivity, and also since the rod-shaped blank is made of a material having substantially the same compositions as the superalloy, the temperature of the anvil electrode and hence the rod-shaped blank is stabilized, and the electric current is passed smoothly from the anvil electrode to the rod-shaped blank. As the speed at which the rod-shaped blank is controlled by only the current supplied to the rod-shaped blank, the rod-shaped blank can be pushed easily at the predetermined speed depending on the displacement by which it is pushed.

The rod-shaped blank can therefore be formed into a preliminary product having a thickened end, for subsequent formation into an engine valve. The thickened end of the preliminary product can subsequently be formed into a valve head by closed-die forging without being subjected to undesired defects.

The predetermined speed is gradually reduced in a latter half of the cycle of forming the preliminary product, so that the preliminary product has a neck near the thickened end, said neck having an angle of inclination smaller than the angle of inclination of a neck of the engine valve.

Immediately after the electric upsetter is actuated, the temperature of the anvil electrode is generally lower than it is when the electric upsetter is in continuous operation. Therefore, the rod-shaped blanks are heated under different conditions immediately after the electric upsetter is actuated and when the electric upsetter is in continuous operation. It is preferable to provide different speed patterns, from which the predetermined speed is selected, for a condition in which the temperature of the anvil electrode is lower immediately after the electric upsetter is actuated and for a condition in which the temperature of the anvil electrode is higher when the electric upsetter is in continuous operation.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
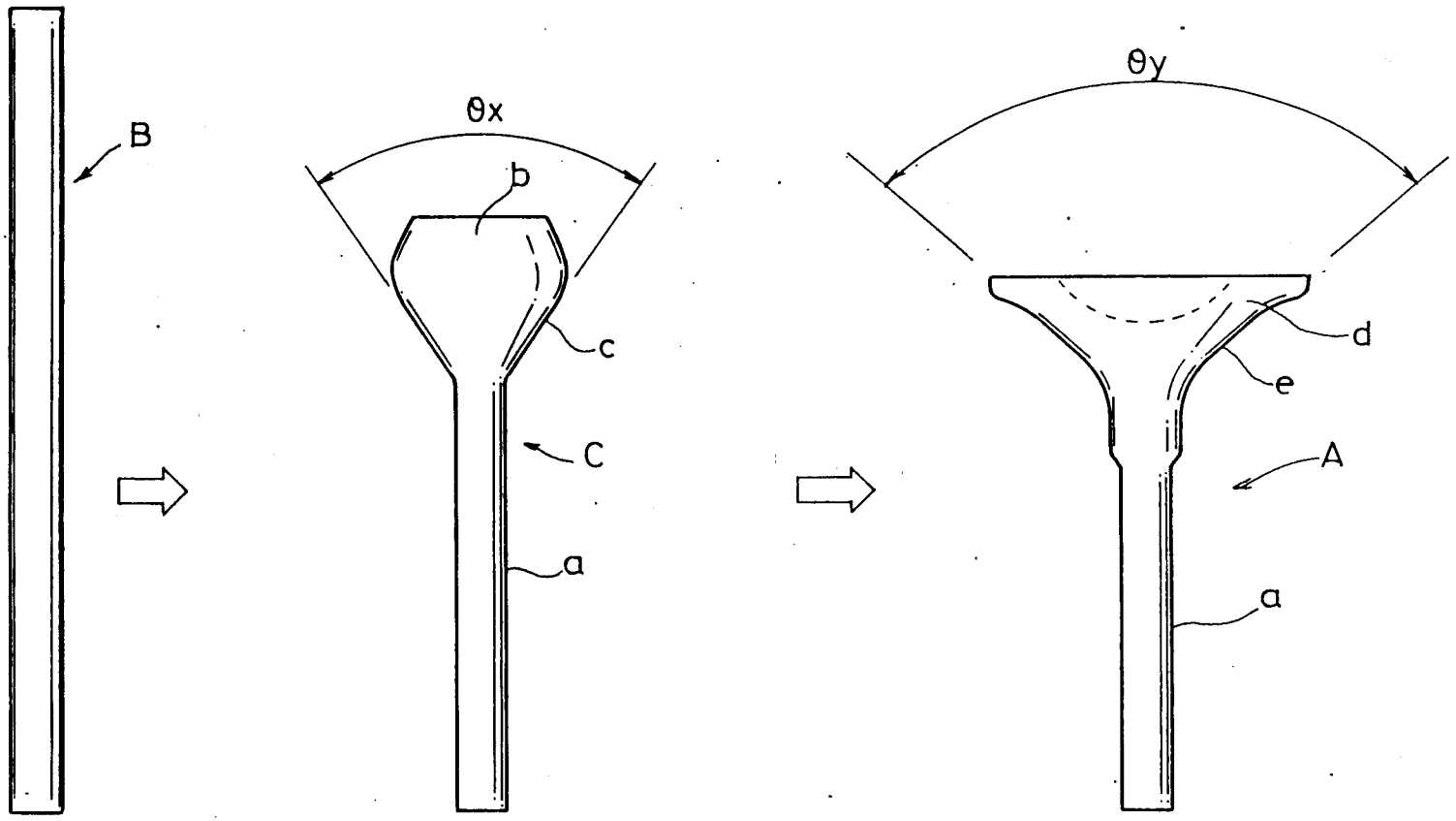
FIG. 1 is a view showing a process of manufacturing an engine valve.

FIG. 1 shows a progressive sequence for manufacturing an engine valve A. First, one end a rod-shaped blank B of a heat-resistant superalloy, which has the same diameter as that of a stem a of the engine valve A to be formed, is enlarged or thickened at b by an electric upsetter 1 (FIG. 2), thereby producing a preliminary product C. The thickened end b of the preliminary product C is then formed into a valve head d by closed-die forging.

The thickened end b of the preliminary product C is progressively smaller in diameter from its maximum-diameter central region toward its distal end away from the stem a and also toward the stem a. A region c extending from the maximum-diameter central region toward the stem a (hereinafter referred to as a "preliminary neck c") has an angle $\theta x$ of inclination which is smaller than an angle $\theta y$ of inclination of a neck e lying between the valve head d of the valve A, formed from the thickened end b, and the stem a.

The heat-resistant superalloy, of which the rod-shaped blank B is formed, may be any of Ni-base heat-resistant superalloys such as Nimonic 90, Nimonic 100, Waspaloy, Hastelly 235, Inconel 750 and Inconel 713 which correspond to NCF 750 and NCF 751 of JIS, and Co-base heat-resistant superalloys such as MAR.M 302(b) and MAR.M 322(b). The compositions of these superalloys are given in Table 1.

TABLE 1

| | Composition (%) | | | | | | | | | | | | | |
|---|---|---|---|---|---|---|---|---|---|---|---|---|---|---|
| Superalloy | C | Ni | Cr | Co | Mo | Ti | Al | Fe | B | Nb | Mn | Si | W | Zr |
| Nimonic 90 | <0.13 | >54.0 | 19.5 | 18.0 | — | 2.4 | 1.4 | <5.0 | — | — | — | — | — | — |
| Nimonic 100 | <0.30 | >51.0 | 15.0 | 20.0 | 5.0 | 1.5 | 5.0 | <2.0 | — | — | — | — | — | — |
| Waspaloy | 0.07 | >71.0 | 19.0 | — | 4.0 | 3.0 | 1.3 | <1.0 | 0.005 | — | — | — | — | — |
| Hastelly 235 | 0.15 | >62.0 | 15.5 | 2.5 | 5.5 | 2.3 | 2.0 | <10.0 | 0.05 | — | — | — | — | — |
| Inconel 750 | 0.04 | >75.0 | 15.0 | — | — | 2.5 | 0.8 | 6.75 | — | 0.85 | — | — | — | — |
| Inconel 713 | 0.14 | >76.0 | 11.5 | — | 4.5 | 0.6 | 6.0 | 1.0 | — | 2.0 | — | — | — | — |
| MAR.M 302(b) | 0.85 | — | 21.5 | 67.0 | — | — | — | — | 0.005 | — | 0.10 | 0.20 | 10.0 | 0.15 |
| MAR.M 322(b) | 1.00 | — | 21.5 | 65.0 | — | 0.75 | — | — | — | — | 0.10 | 0.10 | 9.0 | 2.25 |

A method of forming the preliminary product C will be described in detail below with reference to FIGS. 2 through 5.

Figure 2:
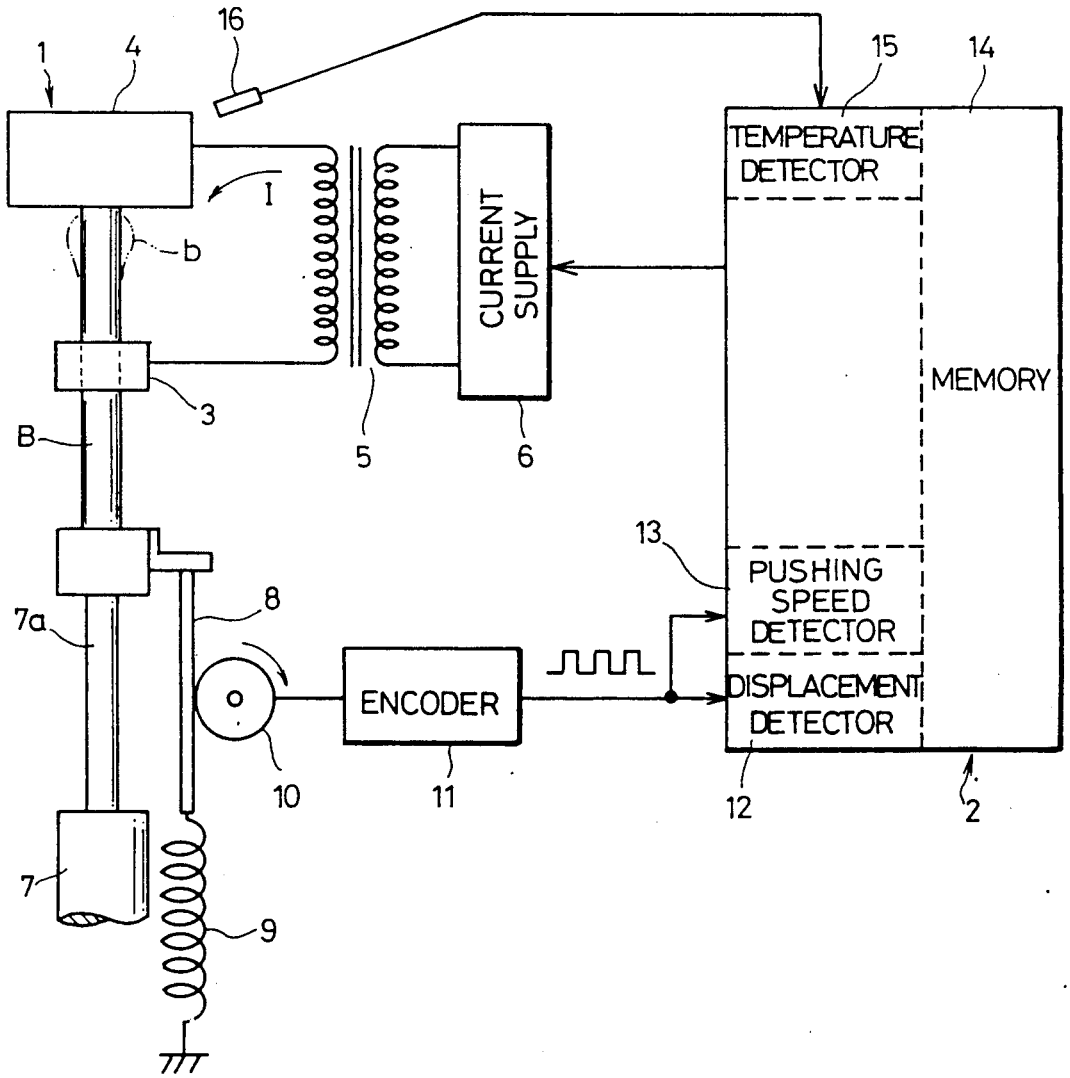
FIG. 2 is a block diagram showing the manner in which a preliminary product for an engine valve is formed by an electric upsetter.

In FIG. 2, the electric upsetter 1 is controlled by a controller 2. When the preliminary product C is to be formed by the electric upsetter 1, an intermediate portion of the rod-shaped blank B is held by an electrode 3, and one end of the rod-shaped blank B abuts against an anvil electrode 4.

The anvil electrode 4 is made of an Ni-base or Co-base heat-resistant superalloy which is less thermally conductive than copper alloys. More specifically, the anvil electrode 4 is cast of any one of the Ni- and Co-base heat-resistant superalloys listed in Table 1 above and having the same or substantially the same compositions as those of the rod-shaped blank B. After the anvil electrode 4 is cast, it is quenched in water immediately from its solid-phase condition at high temperature. The anvil electrode 4 thus quenched becomes denser and more durable than would be if it were cooled in air or wind (see Table 2 below).

The Ni- or Co-base heat-resistant superalloy of the anvil electrode 4 has a thermal conductivity of about 0.03 J/cm.A.K. or less. Copper alloys which have heretofore been used as anvil electrode materials have a thermal conductivity of about 3.5 J/cm.A.K. Therefore, the thermal conductivity of the anvil electrode 4 is much lower than that of the conventionally manufactured anvil electrode.

The electric upsetter 1 has a current supply 6 connected through a transformer 5 to the electrodes 3, 4 thereof. The current supply 6 supplies a current I through the transformer 5 to a rod-shaped blank B held between the electrodes 3, 4 depending on a control voltage (described later) which is applied by the controller 2. The current I thus supplied passes through the rod-shaped blank B to heat the same.

The electric upsetter 1 has a cylinder 7 disposed in opposed relationship to the anvil electrode 4 with the clamp electrode 3 positioned therebetween. The cylinder 7 has a piston rod 7*a* whose distal end is concentrically held against one end, remote from the anvil electrode 4, of the rod-shaped blank B which is held by the clamp electrode 3.

A wire 8 having one end fixed to the distal end of the piston rod 7*a* extends parallel to the piston rod 7*a* alongside thereof, the wire 8 being connected at one end to a spring 9 and kept under tension thereby. The wire 8 is movable with the piston rod 7*a* toward the anvil electrode 4. A pulley 10 is held in rolling engagement with an intermediate portion of the wire 8, so that the pulley 10 can rotate as the wire 8 is axially moved with the piston rod 7*a*. The pulley 10 is operatively connected to an encoder 11 which generates a pulse each time the pulley 10 rotates through a predetermined angular interval, i.e., each time the piston rod 7*a* is axially displaced by a predetermined distance.

The preliminary product C is formed using the electric upsetter 1 as follows: The rod-shaped blank B, with one end thereof being held against the anvil electrode 4, is held by the clamp electrode 3 and heated between the electrodes 3, 4 by a current that is supplied from the current supply 6. Then, the piston rod 7*a* engaging the other end of the rod-shaped blank B is extended toward the anvil electrode 4, thereby displacing the rod-shaped blank B axially toward the anvil electrode 4 under a certain pushing force. The end of the rod-shaped blank B which is held against the anvil electrode 4 is radially enlarged or thickened into the thickened end b under pressure, whereupon the preliminary product C is formed.

Figure 3:
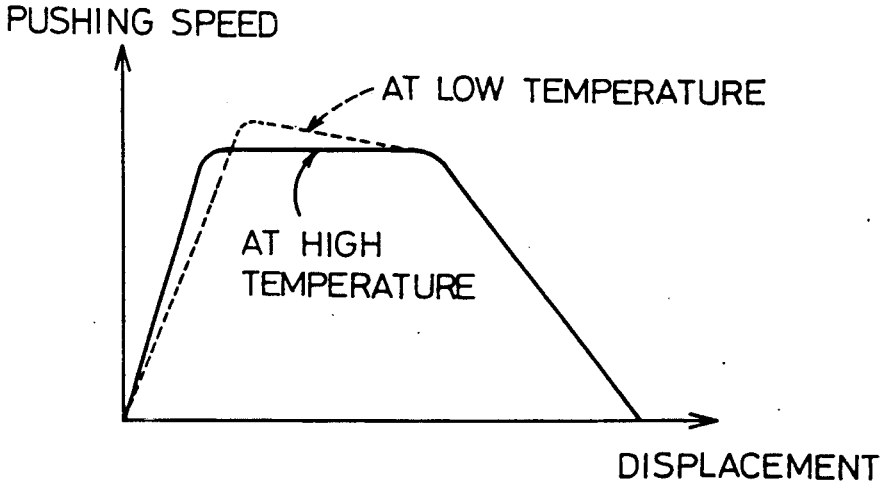
FIG. 3 is a graph showing how the electric upsetter is controlled.

The speed at which the piston rod 7*a* pushes or displaces the rod-shaped blank B is varied depending on the displacement of the rod-shaped blank B, i.e., the degree to which the rod-shaped blank B is pushed toward the anvil electrode 4, according to a pattern indicated by the solid line or the broken line in FIG. 3 depending on the temperature of the anvil electrode 4.

More specifically, when the rod-shaped blank B starts being pushed or displaced, the speed at which it is pushed is also gradually increased. Then, the rod-shaped blank B is pushed continuously to a certain extent at a substantially constant speed. Thereafter, the speed at which the rod-shaped blank B is pushed (hereinafter referred to as a "pushing speed") is gradually lowered when the stroke of displacement of the rod-shaped blank B (hereinafter referred to as a "pushing stroke") nears its end. In this manner, the enlarged or thickened end b of desired shape is formed. When the pushing stroke rears its end, in particular, the rod-shaped blank B is shortened and the electric resistance between the electrodes 3, 4 is reduced. Therefore, the rod-shaped blank B becomes heated more intensively than before, tending to buckle, localize its material, or crack. To avoid these defects, the pushing speed is gradually lowered when the pushing stroke nears its end. With the pushing speed being thus lowered, the enlarged end b is formed such that the angle $\theta x$ of inclination of the preliminary neck c will be smaller than the angle $\theta y$ of inclination of the neck e of the formed valve A.

Immediately after the electric upsetter 1 is actuated, the temperature of the anvil electrode 4 is lower than when the electric upsetter 1 is in continuous operation, and hence it takes more time to heat the rod-shaped blank B immediately after the rod-shaped blank B starts being pushed or displaced. When the temperature of the anvil electrode 4 is lower, therefore, the pushing speed is increased at a rate lower than when the electric upsetter 1 is in continuous operation, so that the rod-shaped blank B is heated more intensively. Accordingly, the end of the rod-shaped blank B which is pressed against the anvil electrode 4 is formed into the thickened end b of desired shape even when the temperature of the anvil electrode 4 is relatively low.

As shown in FIG. 3, there are different pushing speed patterns, indicated by the broken and solid lines, which are to be selectively followed depending on whether the anvil electrode 4 is lower or higher than a predetermined temperature. The current I supplied from the current supply 6 is controlled by the controller 2 such that the pushing speed for the rod-shaped blank B is varied according to the solid-line or broken-line pattern depending on the temperature of the anvil electrode 4. Such current control will be described below.

As shown in FIG. 2, the controller 2 has a displacement detector 12 for continually detecting the displacement by which the rod-shaped blank B is axially pushed, a pushing speed detector 13 for continually detecting the pushed by the displacement, a memory 14 for storing the pushing speed patterns, and a temperature detector 15 for continually detecting the temperature of the anvil electrode 4. The displacement detector 12 and the pushing speed detector 13 detect the displacement and the pushing speed, respectively, from the pulses generated by the encoder 11. The temperature detector 15 detects the temperature of the anvil electrode 4 from a signal produced by a temperature sensor 16 which is positioned closely to the anvil electrode 4.

Figure 4:
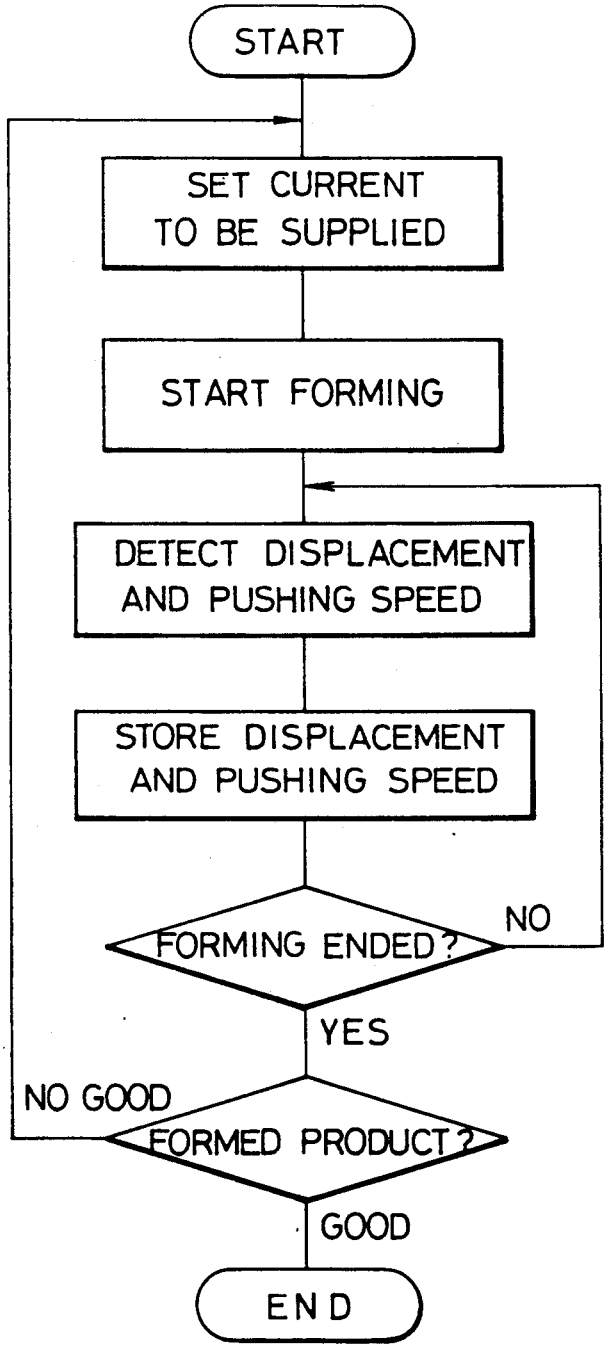
FIGS. 4*a* and 4*b* are flowcharts of a process of controlling the electric upsetter.
Figure 4B:
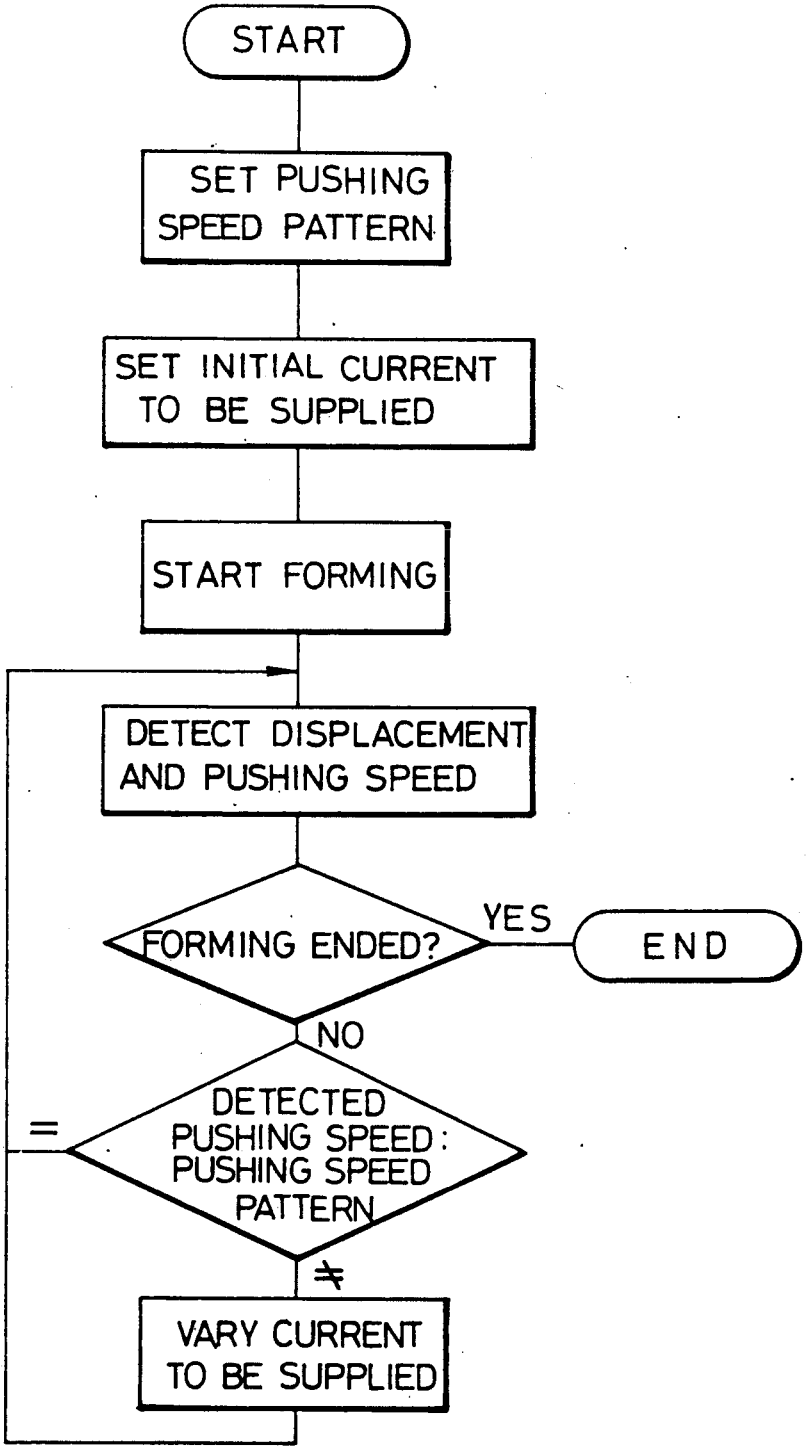

The pushing speed patterns are set up in the manner described below. As shown in the flowchart of FIG. 4(*a*), an appropriate value is established for the current I to be passed through the rod-shaped blank B, and the current I is supplied to form a rod-shaped blank B into a preliminary product C on a trial basis. A pattern of pushing speeds with respect to displacements of the rod-shaped blank B, at the time the rod-shaped product B is formed into the preliminary product C without suffering any of the above defects, is stored in the memory 14 of the controller 2.

More specifically, after the value for the current I is established, the rod-shaped blank B starts being formed on a trial basis. At the same time, time-dependent displacements and pushing speeds of the rod-shaped blank B are detected by the displacement detector 12 and the pushing speed detector 13, respectively, and stored in the memory 14. When the trial preliminary product C is formed, it is determined whether it is of a desired shape or not. If the formed preliminary product C is not of a desired shape, the value for the current I is varied and the above trial production process is repeated. If the formed preliminary product C is of a desired shape, then the trial production process is finished.

At the time the trial production process is finished, therefore, the data stored in the memory 14 represent a pattern of pushing speeds with respect to displacements at the time the rod-shaped blank B is formed into a desired shape. In this manner, different pushing speed patterns depending on the anvil electrode temperature are established.

After the pushing speed pattern is stored in the memory 14, a rod-shaped blank B is formed according to the flowchart of FIG. 4(*b*).

More specifically, one of the low- and high-temperature pushing speed patterns shown in FIG. 3 is selected depending on the temperature of the anvil electrode 4 which is detected by the temperature detector 15. After an initial value is set up for the current I, a rod-shaped blank B starts being formed into a preliminary product C. The displacement and pushing speed of the rod-shaped blank B are continually detected respectively by the displacement detector 12 and the pushing speed detector 13 until the preliminary product C is formed. The detected pushing speed and the selected pushing speed pattern are continually compared with each other by the controller 2. If the detected pushing speed is different from the selected pushing speed pattern, then the controller 2 varies the current I so that the detected pushing speed will be equalized to the pushing speed pattern.

Figure 5:
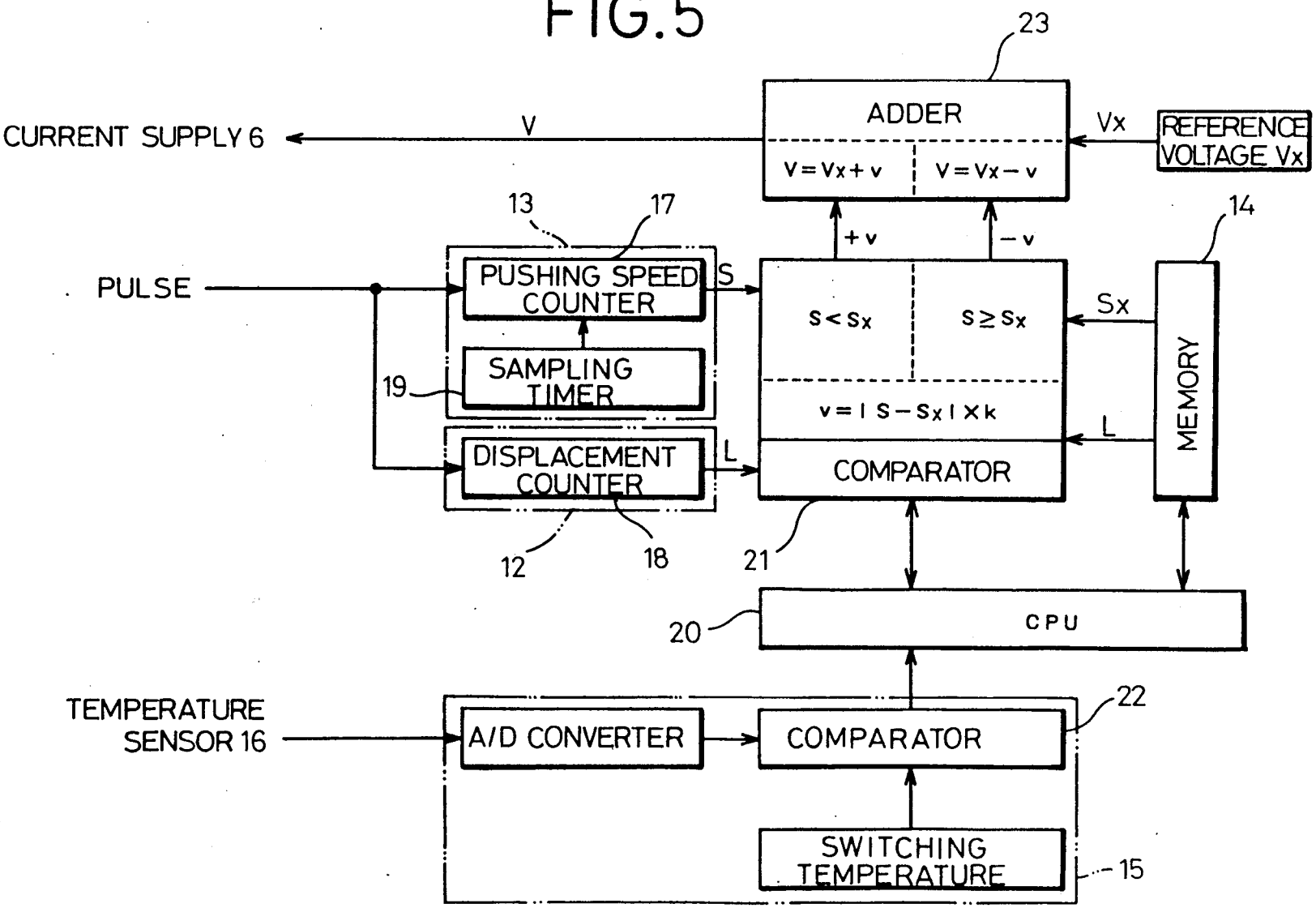
FIG. 5 is a block diagram of a control system for the electric upsetter.

As shown in FIG. 5, the pushing speed detector 13 and the displacement detector 12 have a pushing speed counter 17 and a displacement counter 18, respectively. The pulses from the encoder 11 are supplied to the pushing speed counter 17 and the displacement counter 18.

The pushing speed counter 17 counts pulses in a unit time which is indicated by a sampling timer 19. Since pulses are applied each time the piston rod *7a* of the cylinder 7 is displaced a predetermined interval, and hence each time the rod-shaped blank B is pushed a predetermined interval, the pulse count of the pushing speed counter 17 corresponds to a pushing speed S at the time the pulses start being counted. The pushing speed S is supplied to a comparator 21 which is controlled by a CPU 20. When the pushing speed S is supplied to the comparator 21, the pushing speed counter 17 is cleared, and starts counting pulses again.

The displacement counter 18 counts pulses successively from the time when the rod-shaped blank B starts being pushed. The pulse count of the displacement counter 18 therefore corresponds to a displacement L from the time when the rod-shaped blank B starts being pushed. The displacement L is continually supplied to the comparator 21.

Therefore, the comparator 21 is continually supplied with the displacement L of the rod-shaped blank B and the pushing speed S with respect thereto.

The temperature detector 15 has a comparator 22 for comparing a digital signal converted from an analog signal from the temperature sensor 16 and a switching temperature for selecting one of the pushing speed patterns depending on the temperature of the anvil electrode I. An output signal from the comparator 22 is applied to the CPU 20.

Depending on the output signal from the comparator 22, the CPU 20 controls the memory 14 to supply the comparator 21 with a pushing speed Sx with respect to the displacement L according to one of the low- and high-temperature pushing speed patterns. Specifically, the pushing speed Sx supplied from the memory 14 to the comparator 21 is different depending on whether the anvil electrode I is or a lower temperature or a higher temperature. The anvil electrode 4 has a low thermal conductivity since it is made of an Ni- or Co-base heat-resistant superalloy. The temperature of the anvil electrode 4 is therefore stable and can reliably be detected by the temperature sensor 16. Accordingly, switching between different pushing speeds depending on the anvil electrode temperature is reliably effected.

The comparator 21 compares the pushing speeds S, Sx supplied thereto, and applies a voltage v, depending on the result of comparison, to an adder 23 which supplies a control voltage V to the current supply 6.

More specifically, he comparator 21 applies a positive voltage $+v$ to the adder 23 when the pushing speed S is lower than the pushing speed Sx ($S<Sx$) and a negative voltage $-v$ to the adder 23 when the pushing speed S is equal to or higher than the pushing speed Sx ($S \geqq Sx$). The voltage v is added to a predetermined reference voltage Vx, and the sum is applied as the control voltage V to the current supply 6. The voltage v is given as $v=|S-Sx|\times K$ where K is a constant.

Therefore, when $S<Sx$, the control voltage V is greater than the reference voltage Vx by the voltage v, and when $S>Sx$, the control voltage v is smaller than the reference voltage Vx by the voltage v. The current supply 6 controls the phase of the current I to be supplied to the rod-shaped blank B with a thyristor or the like (not shown) depending on the control voltage V, thereby varying the current I, depending on the change in the control voltage V, so that the pushing speed S for the rod-shaped blank B will be equalized to the pushing speed Sx according to the pushing speed pattern. Therefore, the pushing speed S for the rod-shaped blank B is controlled so as to follow the pushing speed pattern. The rod-shaped blank B is thus formed into the preliminary product C of desired configuration.

An experiment was conducted to form preliminary products C using the electric upsetter 1 according to the illustrated embodiment and also to form preliminary products using the conventional electric upsetter with the anvil electrode being made of stainless steel (SUS304) Defective product percentage and anvil electrode life in the experiment are given in Table 2 below.

TABLE 2

| | Conventional example | Inventive example | | |
|---|---|---|---|---|
| Electrode material | SUS304 | Inconel 713 | | MAR.M 302 |
| Cooling method after casting | — | Air-cooled | Water-cooled | Water-cooled |
| Defective product percentage (%) | 0.25 | 0.05 | 0.03 | 0.03 |
| Anvil electrode life (number of forming cycles) | 400 | 2000 | 3500 | 3000 |

Table 2 indicates that the defective product percentage is much lower and the anvil electrode durability is much greater with the electric upsetter 1 of the present invention than with the conventional electric upsetter. The durability of the anvil electrode is increased by the fact that the anvil electrode is hardened by being cooled in water.

A process of forming the valve A from the preliminary product C will be described below with reference to FIGS. 6 and 7.

Figure 6:
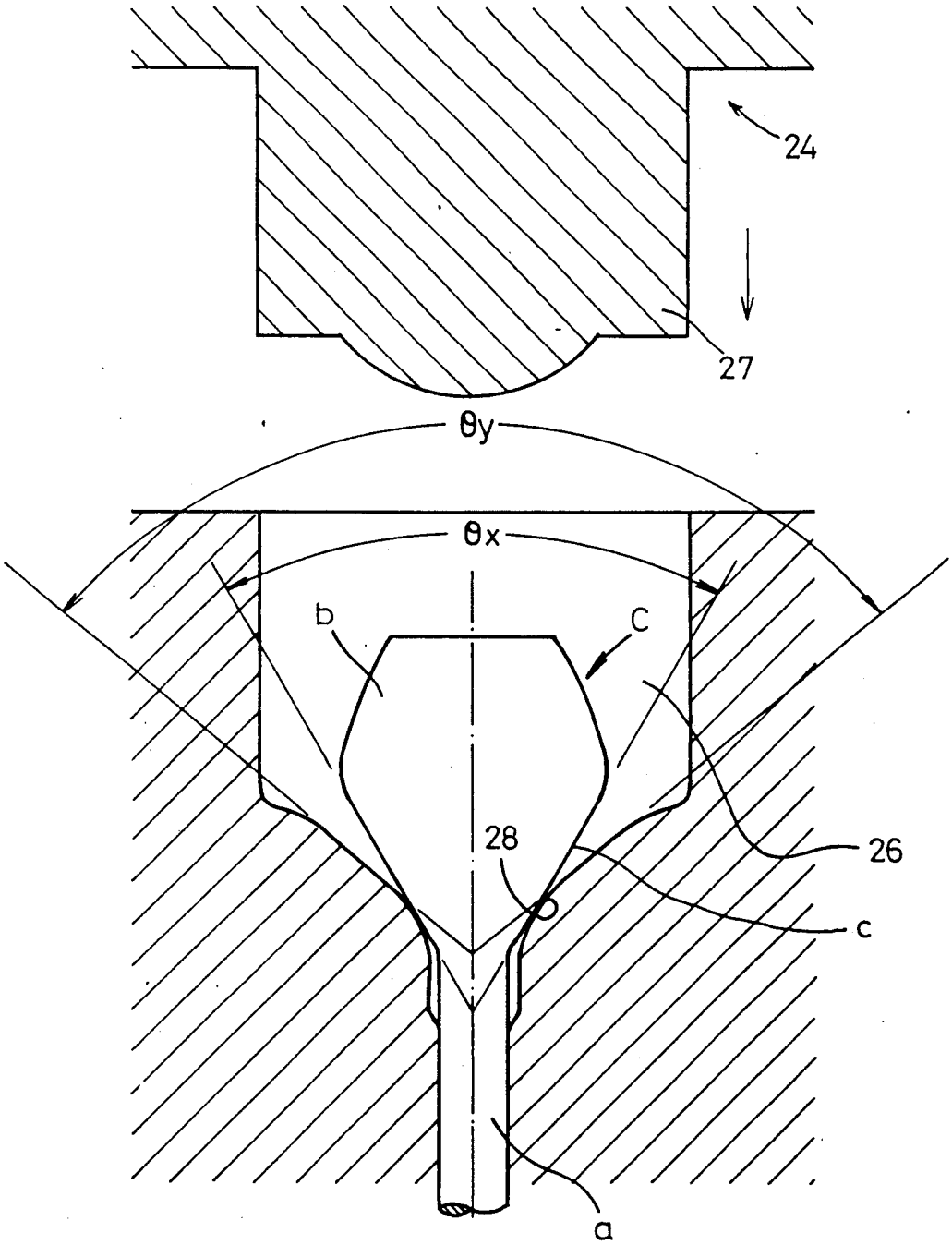
FIGS. 6 and 7 are enlarged fragmentary cross-sectional views showing a process of forming an engine valve from a preliminary product by closed-die forging.
Figure 7:
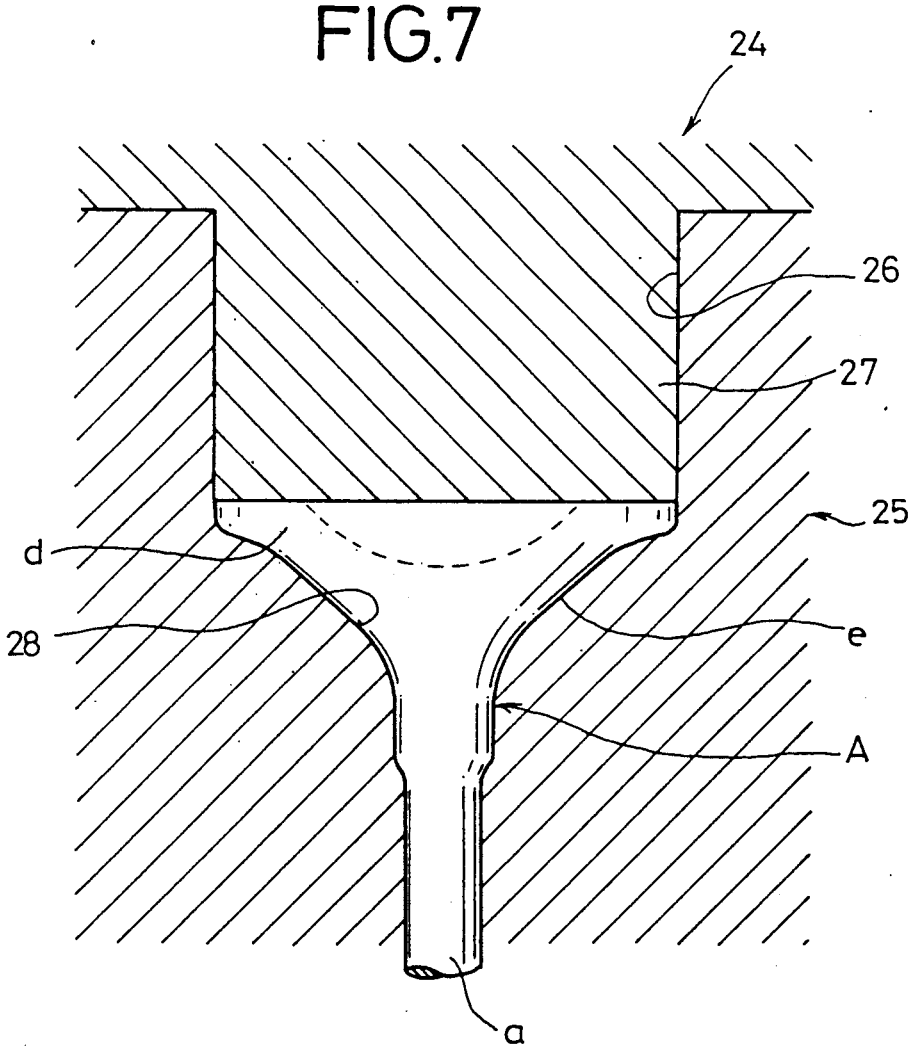

As shown in FIGS. 6 and 7, the preliminary product C is placed in a cavity 26 defined in a lower die 25 which is disposed below an upper die 24 that is moved toward the lower die 25. The upper die 24 has a punch 27 projecting downwardly. The punch 27 is fitted in the cavity 26 when the upper die 24 is moved downwardly toward the lower die 25. When the preliminary product C is formed into the valve A, the thickened end b of the preliminary product C is shaped by closed-die forging between the punch 27 and the cavity 26, as shown in FIG. 7.

The cavity 26 has a lower forming surface 28 for forming the neck e of the valve A, the forming surface 28 being inclined at an angle which is the same as the angle $\theta y$ of inclination of the neck g. The angle $\theta y$ of inclination of the neck e is greater than the angle $\theta x$ of inclination of the preliminary neck c.

Therefore, as shown in FIG. 6, no large gap is created between the forming surface 28 of the lower die 25 and the thickened end b of the preliminary product C. When the thickened end b is formed into the head d of the valve A by closed-die forging as shown in FIG. 7, wrinkles or other defects are not produced on the neck e of the valve A.

Since the preliminary product C is reliably formed uniformly into a shape which is suitable for being subsequently pressed into a valve head, the preliminary produced C will be formed into the desired valve A without any material localization or other deficiencies.

Although a certain preferred embodiment has been shown and described, it should be understood that many changes and modifications may be made therein without departing from the scope of the appended claims.

What is claimed is:

1. A method of forming a metallic product with an electric upsetter having anvil and clamp electrodes, comprising the steps of:

providing the anvil electrode, wherein said anvil electrode is made of a material having a relatively low thermal conductivity;

placing a rod-shaped blank of a metallic material between the anvil and clamp electrodes;

passing an electric current through the rod-shaped blank to heat said rod-shaped blank;

pushing the rod-shaped blank at one end thereof toward the anvil electrode under a constant force to thicken an opposite end of the rod-shaped blank;

detecting a displacement by which said one end of said rod-shaped blank is pushed toward said anvil electrode;

detecting a speed at which said one end of the rod-shaped blank is pushed toward said anvil electrode; and controlling the electric current passed through the rod-shaped blank such that the rod-shaped blank is pushed at a predetermined speed depending on the displacement by which said one end of the rod-shaped blank is pushed toward the anvil electrode, thereby producing a preliminary product with a thickened end.

2. A method according to claim 1, wherein said anvil electrode is made of a nickel- or cobalt-base heat-resistant superalloy whose thermal conductivity is about 0.03 J/cm.A.K. or less.

3. A method according to claim 2, wherein said superalloy contains at least 50% of nickel.

4. A method according to claim 2, wherein said superalloy contains at least 60% of cobalt.

5. A method according to claim 2, wherein said rod-shaped blank is made of a material having substantially the same compositions as said superalloy.

6. A method according to claim 1, wherein said predetermined speed is selected from one of a first speed pattern used when said anvil electrode is of a lower temperature and a second speed pattern used when said anvil electrode is of a higher temperature while the electric upsetter is in continuous operation.

7. A method according to claim 1, wherein said electric current is controlled so that said predetermined is speed is gradually lowered when the cycle of forming the metallic product nears its end.

8. A method according to claim 1, wherein said metallic product is an engine valve, said preliminary product being shaped similarly to the final shape of the engine valve, further comprising the step of forming the thickened end of the preliminary product into a valve head by closed-die forging, thereby producing the engine valve.

9. A method according to claim 8, wherein said predetermined speed is gradually reduced in a latter half of the cycle of forming the preliminary product, and the preliminary product has a neck near the thickened end, said neck having an angle of inclination smaller than the angle of inclination of a neck of the engine valve.

10. A method of forming a metallic product with an electric upsetter having anvil and clamp electrodes, comprising the steps of:

providing the anvil electrode, wherein said anvil electrode is made of a nickel- or cobalt-base heat-resistant superalloy having a thermal conductivity of about 0.03 J/cm.A.K. or less;

placing a rod-shaped blank, which is made of a heat-resistant superalloy having substantially the same composition as the anvil electrode, between the anvil and clamp electrodes;

passing an electric current through the rod-shaped blank to heat said rod-shaped blank, while applying a constant force to one end of the rod-shaped blank to push the rod-shaped blank toward the anvil electrode;

detecting a displacement by which said one end of said rod-shaped blank is pushed toward said anvil electrode;

detecting a speed at which said one end of the rod-shaped blank is pushed toward said anvil electrode;

controlling the electric current passed through the rod-shaped blank such that the rod-shaped blank is pushed at a predetermined speed depending on the displacement by which said one end of the rod-shaped blank is pushed toward the anvil electrode, thereby producing a preliminary product with a thickened end; and forming the thickened end into a head by closed-die forging, thereby producing an engine valve.

11. A method according to claim 10, wherein said superalloy contains at least 50% of nickel.

12. A method according to claim 10, wherein said superalloy contains at least 60% of cobalt.

13. A method according to claim 10, wherein said predetermined speed is gradually reduced in a latter half of the cycle of forming the preliminary product, and the preliminary product has a neck near the thickened end, said neck having an angle of inclination smaller than the angle of inclination of a neck of the engine valve.

* * * * *